United States Patent [19]

Borglum

[11] 4,203,380

[45] May 20, 1980

[54] RUDDER ASSEMBLY

[76] Inventor: Keith B. Borglum, 218 Loma, Waterloo, Iowa 50701

[21] Appl. No.: 886,413

[22] Filed: Mar. 14, 1978

[51] Int. Cl.[2] ..... B63H 25/00

[52] U.S. Cl. ..... 114/144 R

[58] Field of Search ..... 114/144 R, 162

[56] References Cited

U.S. PATENT DOCUMENTS

| | | | |
|---|---|---|---|
| 45,959 | 1/1865 | Crosby | 114/162 |
| 635,951 | 10/1899 | Anderson | 114/144 |
| 715,176 | 12/1902 | Swan | 114/162 |
| 1,705,133 | 3/1929 | Oertz | 114/162 |
| 1,795,346 | 3/1931 | Rebl | 114/162 |
| 1,973,783 | 9/1934 | Thorsen | 114/162 |
| 2,068,618 | 1/1937 | Wilford | 244/17.17 |
| 2,099,229 | 11/1937 | Possenheim | 114/162 |
| 3,221,699 | 12/1965 | Vidach | 114/162 |
| 3,834,343 | 9/1974 | Hopkins | 114/162 |

*Primary Examiner*—Charles E. Frankfort
*Assistant Examiner*—James B. Bechtel
*Attorney, Agent, or Firm*—Henderson & Sturm

[57] ABSTRACT

A rudder assembly for a boat including a rudder shaft rotatably mounted to a boat and inclined downwardly and rearwardly. A rudder blade is attached to the lower end of the shaft and a plate is attached to the lower edge of the blade. The inclined shaft permits control of the rudder assembly from the central portion of the boat while allowing the rudder blade to be disposed near the stern for improved control. The plate provides for increasing resistance to the flow of water as the rudder blade is moved to the left or right of the straight-on position.

5 Claims, 6 Drawing Figures

RUDDER ASSEMBLY

BACKGROUND OF THE INVENTION

The present invention relates generally to rudder assemblies for boats and more particularly to a rudder assembly which allows operation of the rudder from the central portion of the boat without the need for complicated linkage.

Conventional rudder assemblies include a substantially vertical rudder shaft with a tiller arm extending forward. Since it is desirable to have the rudder blade near the stern or rear of the boat for better control, the tiller arm is generally operated by an occupant seated near the stern. Prior art rudder assemblies suitable for operation from the forward or central portion of the boat include complicated and cumbersome linkage mechanisms which compound maintenance problems.

SUMMARY OF THE INVENTION

The rudder assembly of the instant invention includes a rudder shaft which is inclined from the vertical, having an axis of rotation inclined rearwardly and downwardly. The tiller arm attached to the upper end of the rudder shaft, therefore, extends forward to the central portion of the boat while the rudder blade attached to the lower end of the rudder shaft is disposed near the stern.

The rudder blade is attached at an oblique angle to the axis of the shaft, therefore, when the rudder blade is moved to the left or right of the straight-on position the vertical contact surface of the blade progressively decreases and provides less resistance to the water. To compensate for the decrease in resistance of the blade, a plate is attached to the lower edge of the blade and disposed perpendicular thereto. As the vertical contact surface of the blade progressively decreases, the vertical contact surface of the plate progressively increases and provides improved steering control.

Although not limited to use on any particular type of watercraft, the rudder assembly of the instant invention is particularly suitable for use with a pontoon boat where the rudder blade is disposed between the pontoons and at a slightly higher elevation than the bottom of the pontoons. Since the rudder blade is attached at an oblique angle to the axis of the shaft, the rearward edge of the blade seeks a lower elevation as the blade is turned from the straight-on position, therefore the rearward edge of the blade avoids contact with the pontoons.

An object of the present invention is the provision of an improved rudder assembly for boats.

Another object is to provide a rudder assembly wherein the rudder can be operated from the central portion of the boat without the need for complicated linkage.

A further object of the invention is the provision of a rudder assembly which is simple in design and easy to maintain.

Other objects, advantages and novel features of the present invention will become apparent from the following detailed description of the invention when considered in conjunction with the accompanying drawings.

DESCRIPTION OF THE PREFERRED EMBODIMENTS

Figure 1:
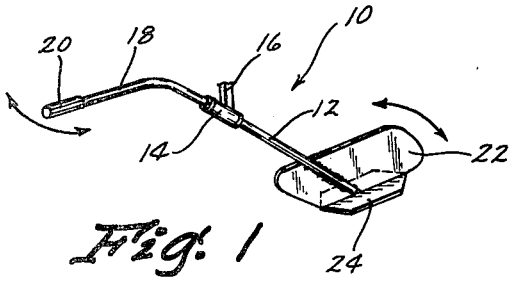
FIG. 1 is a perspective view of the rudder assembly of this invention.
Figure 3:
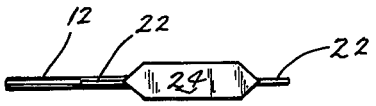
FIG. 3 is a bottom plan view taken along line 3—3 of FIG. 2.

Referring now to the drawings, wherein like reference numerals designate identical or corresponding parts throughout the several views, FIG. 1 shows the rudder assembly 10 including a rudder shaft 12 rotatably received in sleeve 14 attached to bracket 16. A tiller arm 18 having hand grip 20 extends forwardly from the upper end of shaft 12. A rudder blade 22 is attached to the lower end of shaft 12 and plate 24 is rigidly attached to the lower edge of blade 22 and is disposed normal thereto.

Figure 2:
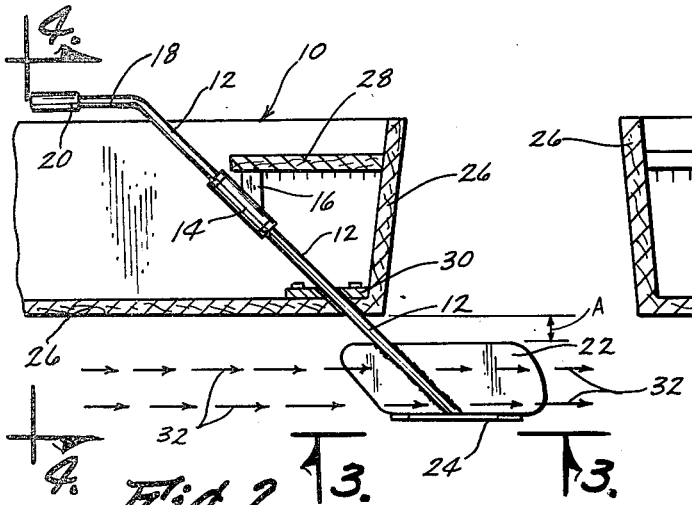
FIG. 2 is a side elevational view of the rudder assembly attached to the hull of a boat (shown in section) wherein the rudder blade is in the straight-on position.

FIG. 2 illustrates the rudder assembly 10 attached to the hull 26 of a typical boat. Bracket 16 is attached to support member 28 which in turn is attached to hull 26. Shaft 12 is rotatably received through a water tight fitting 30 attached to hull 26. Sleeve 14 and fitting 30 maintain shaft 12 in alignment on an axis that extends downwardly and rearwardly from tiller arm 18.

Figure 4:
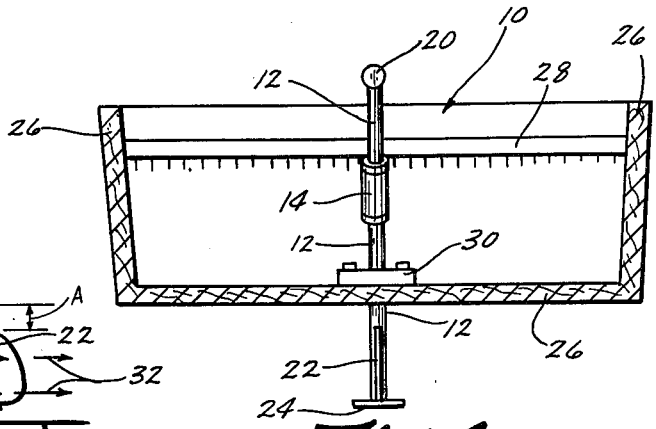
FIG. 4 is a front elevational view taken along line 4—4 of FIG. 2.

FIGS. 2 and 4 show the rudder blade 22 directed along the longitudinal axis of hull 26, in the straight-on or mid point position. As shown in FIG. 2, the water flow lines 32 are substantially undisturbed by blade 22 or plate 24, and blade 22 and plate 24 are horizontally disposed. The top surface of the rudder blade 22 is parallel to, and spaced from the hull 26 surface by a distance designated as A when the rudder blade 22 is directed along the longitudinal axis of the hull 26.

Figure 5:
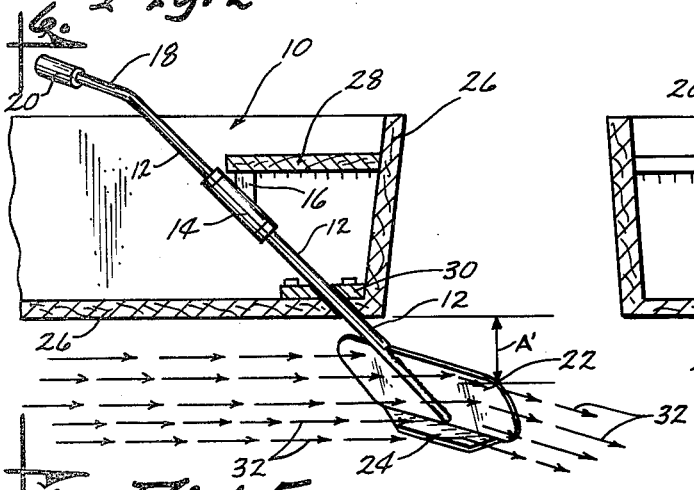
FIG. 5 is a side elevational view similar to FIG. 2 except the rudder blade is turned to the left of the straight-on position.
Figure 6:
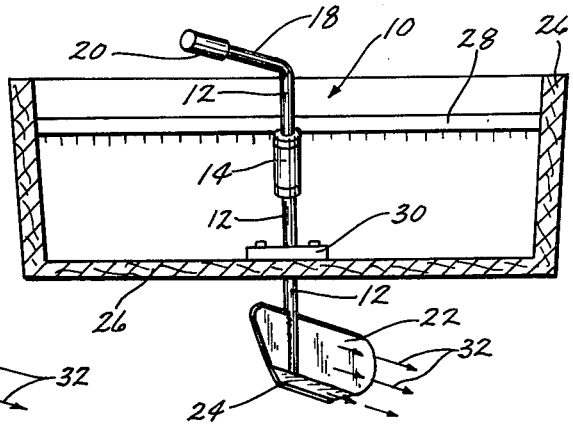
FIG. 6 is a front elevational view taken along line 6—6 of FIG. 5.

FIGS. 5 and 6 show the rudder blade 22 turned to the left of the straight-on position of FIGS. 2 and 4. When in the FIG. 5 position both the rudder blade 22 and the plate 24 provide resistance to the water and cause the boat to turn. FIGS. 5 and 6 also illustrate that the rearward end of blade 22 seeks a lower elevation as blade 22 is turned from the straight-on position. This is particularly evident by comparing the distance designated as A in FIG. 2 with the distance designated as A' in FIG. 5. While the rearward end of blade 22 moves downwardly and away from the hull 26 the forward end of blade 22 moves upwardly and towards the hull 26. Since the rudder blade 22 is disposed at an oblique angle to the axis of rotation of the rudder shaft 12 the rudder blade 22 passes through several horizontal planes with respect to the bottom of the hull 26 as the rudder shaft 12 is rotated from the midpoint position illustrated in FIGS. 2 and 4.

The occupant of the boat may be seated in the central portion of the boat and easily reach the tiller arm 18. The tiller arm 18 is moved from side-to-side rotating shaft 12 in the desired arc to control the direction of travel of the boat.

Thus it can be seen that a novel rudder assembly has been provided which accomplishes at least all of its stated objectives.

Obviously many modifications and variations of the present invention are possible in light of the above teachings. It is therefore to be understood that, within the scope of the appended claims, the invention may be practiced otherwise than as specifically described.

I claim:

1. A rudder assembly for a boat comprising;

a rudder shaft, said rudder shaft being inclined downwardly and rearwardly;

means for rotatably mounting said rudder shaft to said boat;

a rudder blade attached to the lower end of the said rudder shaft;

a plate attached to the lower edge of said rudder blade and disposed normal thereof; and said rudder blade is disposed at an oblique angle to the axis of rotation of said rudder shaft, so that said rudder blade passes through several horizontal planes as said rudder blade is rotated by said rudder shaft.

2. The rudder assembly of claim 1 further comprising;

a tiller arm attached to the upper end of said rudder shaft and extending forward therefrom.

3. The rudder assembly of claim 1 wherein the mounting means includes a cylindrical sleeve adapted to rotatably receive said rudder shaft.

4. The rudder assembly of claim 1 wherein said plate extends outwardly from both sides of said rudder blade.

5. The rudder assembly of claim 4 wherein said plate is rigidly attached to said rudder blade.

* * * * *